United States Patent [19]

Sherman

[11] Patent Number: 4,967,951

[45] Date of Patent: Nov. 6, 1990

[54] ONE-PIECE MAILER

[76] Inventor: Eli L. Sherman, P.O. Box 148052, Chicago, Ill. 60614

[21] Appl. No.: 320,138

[22] Filed: Mar. 7, 1989

[51] Int. Cl.[5] ..... B65D 27/34

[52] U.S. Cl. ..... 229/70; 206/610; 229/92.1; 282/25

[58] Field of Search ..... 229/70, 92.1, 92.3; 206/610; 282/11.5 R, 25

[56] References Cited

U.S. PATENT DOCUMENTS

| | | | |
|---|---|---|---|
| 304,661 | 9/1884 | Pedrick | 229/92.1 |
| 2,354,066 | 7/1944 | Sass | 229/92.1 |
| 2,573,610 | 10/1951 | Russo . | |
| 2,616,199 | 11/1952 | Robins . | |
| 2,644,634 | 7/1953 | Weitzner . | |
| 2,939,234 | 6/1960 | Hill . | |
| 3,030,718 | 4/1962 | Kirkman . | |
| 3,125,337 | 11/1965 | Rosenthal . | |
| 3,327,419 | 6/1967 | Stanos . | |
| 3,606,138 | 9/1971 | Allison | 229/70 |
| 3,673,723 | 7/1972 | Lazar et al. . | |
| 3,718,277 | 2/1973 | Volkert | 229/92.1 |
| 3,797,150 | 3/1974 | Hinckley . | |
| 3,894,684 | 7/1975 | Florey . | |
| 3,955,750 | 5/1976 | Huffman | 229/92.1 |
| 4,044,942 | 8/1977 | Sherwood | 229/92.1 |
| 4,244,127 | 1/1981 | Buzzard . | |
| 4,244,511 | 1/1981 | Coleman . | |
| 4,284,230 | 8/1981 | Schultz | 229/92.1 |
| 4,397,417 | 8/1983 | Carlson | 229/70 |
| 4,531,319 | 7/1985 | Saxton . | |
| 4,567,682 | 2/1986 | Hurxthal . | |
| 4,660,856 | 4/1987 | Shacklett | 229/92.1 |
| 4,676,526 | 6/1987 | Redmon | 229/70 |
| 4,729,182 | 3/1988 | Sherman | 206/492 |

*Primary Examiner*—Stephen P. Garbe

*Attorney, Agent, or Firm*—William Brinks Olds Hofer Gilson & Lione

[57] ABSTRACT

A mailer having a stack of planar items, such as coupons, enclosed within an envelope is formed in one piece from an integral blank. A tear-off tab provides for easy removal of the stacked items from their envelope.

4 Claims, 3 Drawing Sheets

ONE-PIECE MAILER

FIELD OF THE INVENTION

This invention relates to mailers, and more particularly to a one-piece mailer having a stack of planar items contained within an envelope formed integral with the stack.

BACKGROUND OF THE INVENTION

The mailer to which this application is directed represents a modification of the type of mailer shown in applicant's U.S. Pat. No. 4,729,182. The present mailer resulted from an effort to provide a mailer for coupons in particular, which could be formed from an integral blank for ease in printing and manufacture, yet still provide the type of construction shown in the '182 patent.

SUMMARY OF THE INVENTION

The present invention is in a one-piece mailer comprised of a stack portion of a plurality of planar items, such as coupons, and an envelope portion which encloses the stack and is formed integral therewith. The planar items are stacked in facial engagement, as by an accordion fold. One of the planar items has an end extended beyond a first edge of the stack, i.e., this extended planar item is longer than the others.

The envelope portion has a first sheet joined at a first fold line with the extended end of the long planar item. The first sheet covers the top of the stack and extends beyond a second edge of the stack which is opposite from the first edge.

A second sheet is joined to the first sheet at a second fold line. The second sheet covers the bottom of the stack, and is generally coterminous with the first sheet to thereby form an envelope for the stack. To this end, the second sheet is fixed to the long planar item adjacent this planar item's extended end.

A score line (perforation) is formed in each of the first and second sheets adjacent the long planar item's extended end. The score lines are preferably located on top of each other in assembly of the mailer.

The mailer is openable by gripping the first and second sheets adjacent the first and second fold lines, and then tearing the first and second sheets along the score lines. The score lines are designed so that the long planar item, which is sandwiched between the first and second sheets in this area, does not get significantly torn. The stack portion is then withdrawn from within the first and second sheets by the tab formed by the torn segments of the first and second sheets resulting from tearing.

The mailer may further include adhesive means, such as double-sticky tape covered by a release paper, which is provided on one of the first and second sheets on the portion which will ultimately form the tab. The adhesive means can be used for hanging the stack in an unfolded condition after withdrawal.

Another embodiment of the mailer has a longitudinal cut line beginning at a point spaced inwardly of a free end of the last planar item in the stack and extending along that item and one or more other contiguous planar items to a terminus within the stack. This cut line thereby divides these planar items into two parts, such as two rows of coupons. A second cut line extends from the terminus to a side edge of the stack. When the stack is withdrawn, the cut planar items can separate along these cut lines to thereby extend the length of the stack.

The invention and its advantages will be further understood upon consideration of the following detailed description of some embodiments of the invention taken in conjunction with the drawings, in which:

DETAILED DESCRIPTION OF SOME EMBODIMENTS OF THE INVENTION

Figure 1:
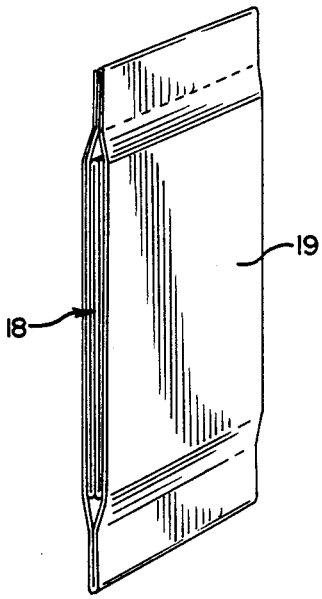
FIG. 1 is a perspective view of a mailer made in accordance with the present invention.

FIG. 1 shows an assembled mailer made according to the present invention as it would be received by a consumer. It is formed from the one-piece blank of paper of FIG. 4 (which is not to scale). The blank is comprised of a plurality of planar items, such as coupons, 10–13. Each coupon is defined by a respective fold line 14–16 with its contiguous neighbor.

Figure 2:
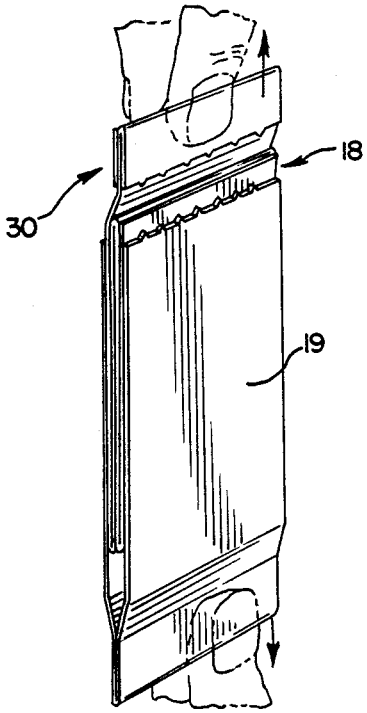
FIG. 2 is a view similar to that of FIG. 1 showing how to open the mailer.

In this embodiment, the coupons (planar items) 10–12 are generally coterminous to form a neat stack 18 (FIGS. 1 and 2). Coupon 13 is slightly longer than the others, however, having an extended end portion **13*a*. This extended end 13*a* joins with a first sheet 19 at a fold line 20. Sheet 19 in turn joins with a second sheet 21 at a fold line 22. Sheets 19 and 21 form the front and back portions of an envelope which encloses the stack 18 when the mailer is assembled. Sheet 19 covers the top of the stack and sheet 21 the bottom, for instance. The sheets 19 and 21 are obviously longer than the coupons 10–13 to thereby enclose the stack 18**.

Perforations 23 and 24 are formed on sheets 19 and 21, respectively. Perforation 23 is made adjacent fold line 20 at a point spaced inwardly therefrom, while perforation 24 is formed on sheet 21 at a point spaced a like distance in from the end **21*a*** of the second sheet.

In assembly, the blank is folded along the folded lines such that the stack 18 is made from an accordion arrangement of the coupons 10–13. Sheets 19 and 21 are then folded around the outside of the stack 18 with fold line 20 meeting edge **21*a*. The perforation lines 23, 24 thereby overlap, with the extended end 13*a* of the long coupon 13 sandwiched in between the sheets in this area. Adhesive 25, or some other fixation means, holds sheet 21 to the extended end 13*a* which it overlies. Adhesive 26 can also be applied to sheet 19 adjacent fold line 20, and adhesive can further be applied on each side of the fold line 22 to better secure the envelope formed by the sheets 19 and 21**.

Figure 3:
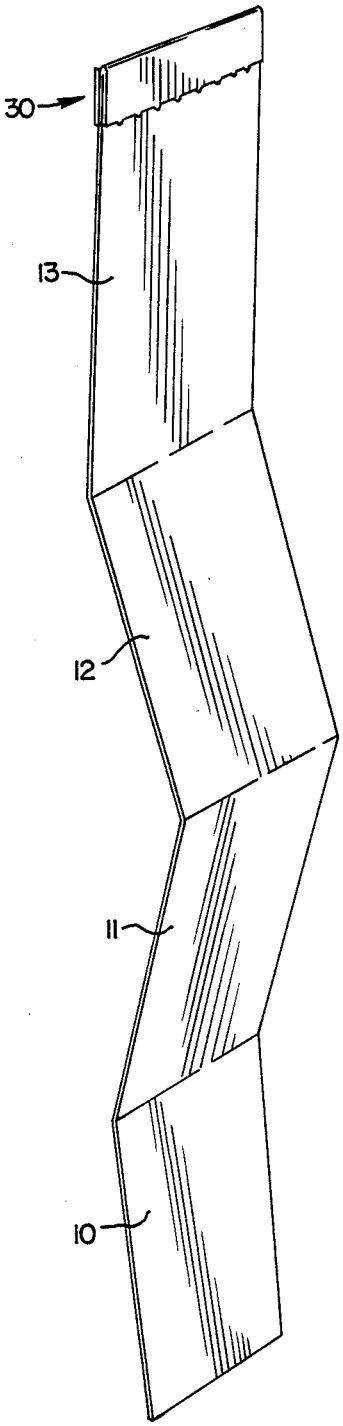
FIG. 3 is a view similar to that of FIGS. 1 and 2 showing the stack of items as removed from the envelope portion of the mailer.

The mailer thus formed is opened by grasping its two ends, as shown in FIG. 2, and tearing the sheets 19, 21 along the perforation lines 23, 24. The torn portions of the sheets surrounding the extended portion **13*a* thereby form a tab 30 with the extended portion which is used to withdraw the stack 18 from the envelope. FIG. 3 shows the stack 18** removed, and the coupons unfolded for display and use.

Figure 5:
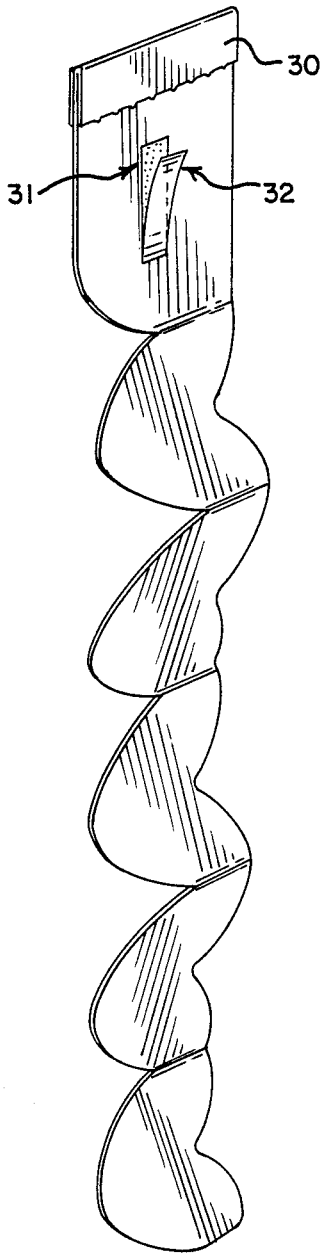
FIG. 5 is a drawing of a mailer stack made of non-rectangular items.

FIG. 5 shows a modified version of the mailer wherein the planar items are non-rectangular, in this case, heart-shaped for a Valentine's Day motif. A strip of double sticky tape 31 is preferably provided on the reverse side of the sheet 33 which lies protected within the envelope before opening. This adhesive tape 31 should be covered by a release paper 32. The tape 31 is beneficial in that it can be used by the consumer to attach the unfolded stack to a wall or the like.

Figure 4:
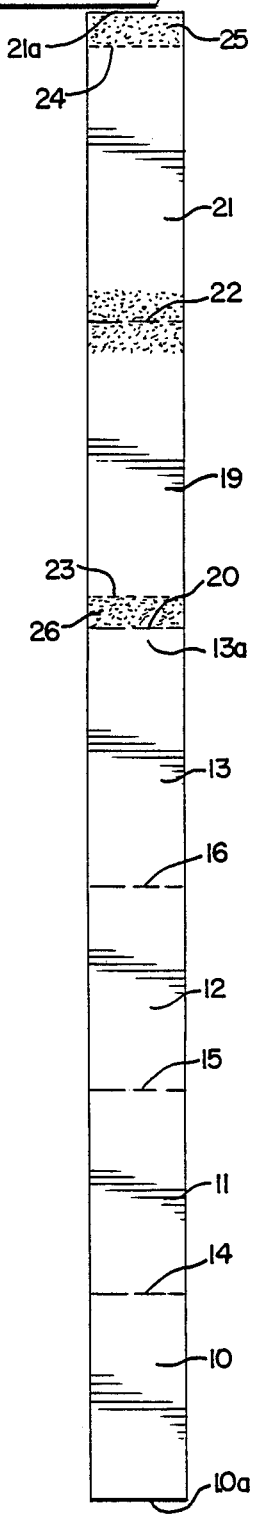
FIG. 4 is a reduced drawing of the blank used to make the mailer of FIGS. 1–3.
Figure 6:
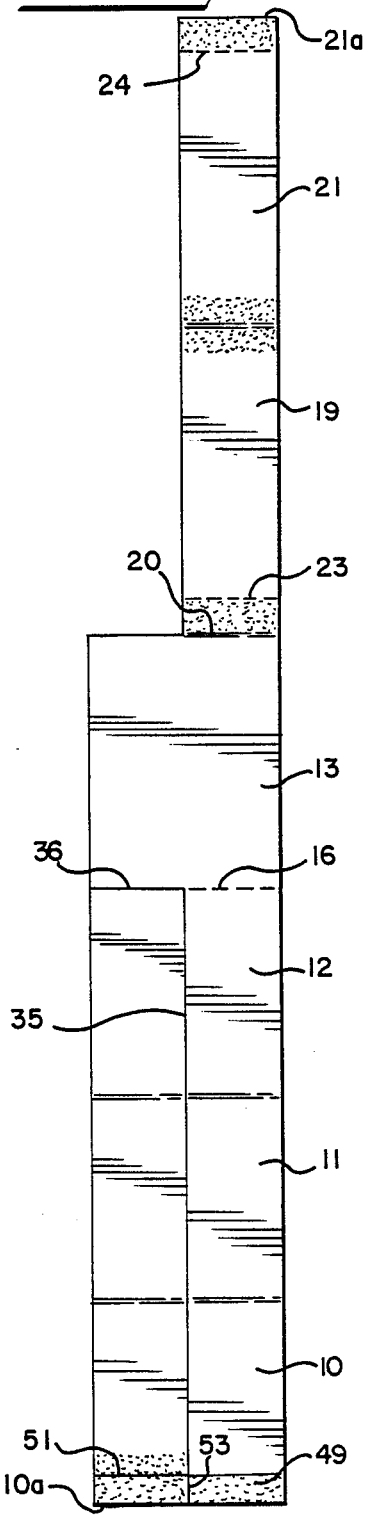
FIG. 6 is a modified version of the mailer blank of FIG. 4 on the same scale; and FIGS. **6*a*–6*c* illustrate the folding procedure for the embodiment of FIG. 6**.

FIG. 6 shows another embodiment of the invention having a width for the elements which is approximately double that of the embodiment of FIG. 4. A cut line 35 is formed in the blank extending from just short of the free end 10*a* of coupon 10 to the fold line 16, which marks the end of coupon 12. This cut line 35 divides the contiguous coupons 10–12 in half. Another cut line 36 extends along the fold line 16 from cut line 35 to a side edge. Thus, when the stack 18 is removed from the envelope, the divided coupons 10–12 form a further extension of the unfolded stack, and increases the number of coupons, and length of the unfolded stack, without increasing the length of the blank to be printed.

Figure 6A:
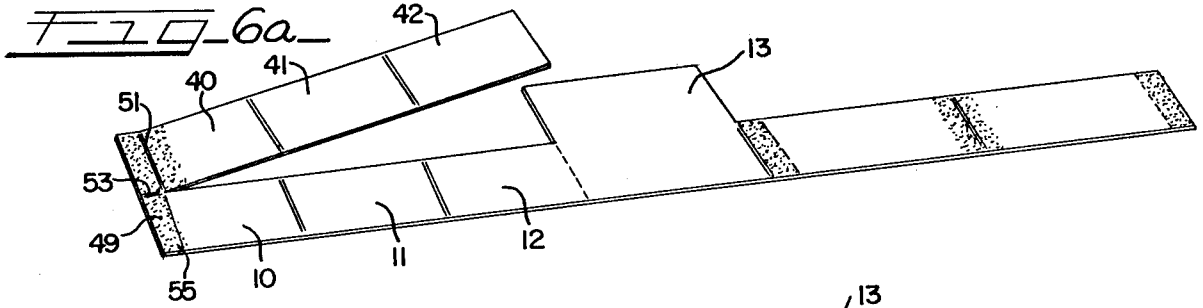
Figure 6B:
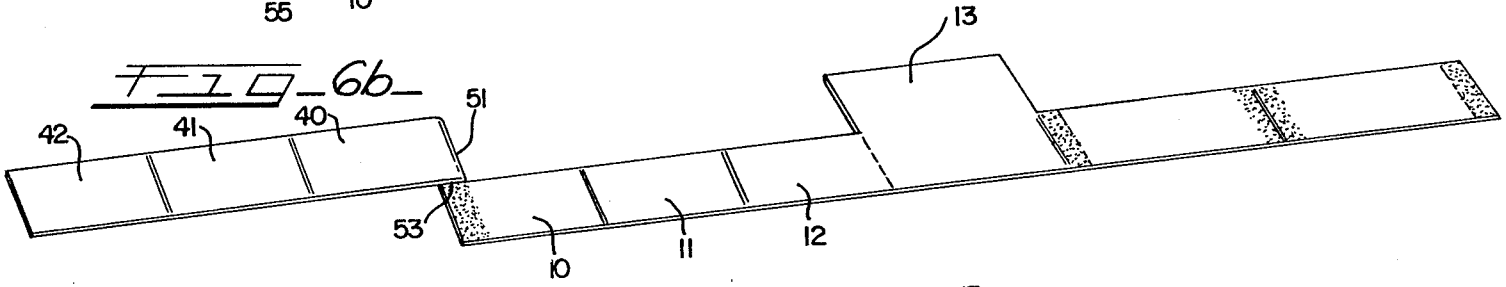
Figure 6C:
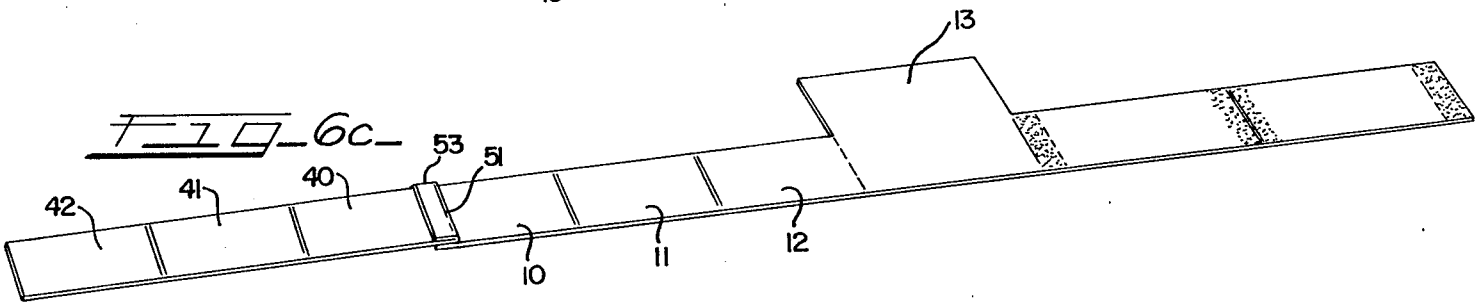

FIGS. 6*a–c* sequentially illustrate the folding procedure for this embodiment. As shown, the coupons 40, 41, and 42 are folded along fold line 51 and glued. The coupons are then folded over on fold line 53 so that the coupons 40, 41, and 42 are now in line with the coupons 10, 11, and 12.

In a preferred embodiment, the glue used to glue at fold line 53 is a peelable type glue. As such, the area designated 55 can be used for printing messages and the like, which messages are thus hidden from view up to the time the coupons are unfolded along fold line 53. In this way, the stack of coupons can be used, for example, in a contest wherein a winning message is printed in a limited number of stacks.

Thus, while the invention has been described with reference to certain presently preferred embodiments, those with skill in the art will recognize modifications of structure, material and arrangement which will still fall within the scope of the invention.

I claim:

1. A one-piece mailer comprising:

a stack of a plurality of planar items, such as coupons, stacked in facial engagement, one of said planar items having an end extended beyond a first edge of said stack, and an envelope portion enclosing said stack, said envelope portion having a first sheet joined at a first fold line with said planar item extended end, said first sheet further covering a top of said stack and extending beyond a second edge of said stack which is opposite from said first edge, and a second sheet joined with said first sheet at a second fold line, said second sheet having a free end, said second sheet covering a bottom of said stack, a score line formed in said first sheet adjacent said planar item extended end and spaced from said first fold line therewith, and a score line formed in said second sheet adjacent said second sheet free end, said second sheet when enclosing said stack, being fixed to said one planar item adjacent said planar item extended end on a side thereof opposite to that of said first sheet, said second sheet being generally co-extensive with said first sheet, said mailer being openable by gripping said first and second sheets adjacent said first and second fold lines, tearing said first and second sheets along said score lines, and withdrawing said stack from within said first and second sheets by a tab formed by torn segments of said first and second sheets resulting from tearing.

2. The mailer of claim 1 further including adhesive means covered by a release paper on one of said first and second sheets between said first fold line and a respective perforation, said adhesive means being useful for hanging said stack in an unfolded condition after withdrawal.

3. The mailer of claim 1 wherein said stacked items are non-rectangular.

4. A mailer formed from a single integral piece of paper comprising:

a stack of a plurality of planar items, such as coupons, stacked in facial engagement through an accordion fold, one of said planar items having an end extended beyond a first edge of said stack, said stack of planar items terminating in a planar item having a free end, at least two of said planar items which are contiguous, and including said planar item having said free end, further having a longitudinal cut line beginning at a point spaced inwardly of said free end and extending along said contiguous planar items to a terminous to thereby divide said contiguous planar items into two parts, and a second cut line extending from said terminus to a side edge of said stack, an envelope portion enclosing said stack, said envelope portion having a first sheet joined at a first fold line with said planar item extended end, said first sheet further covering a top of said stack and extending beyond a second edge of said stack which is opposite from said first edge, and a second sheet joined at a second fold line with said first sheet, said second sheet having a free end, said second sheet covering a bottom of said stack, a score line formed in said first sheet adjacent said planar item extended end and spaced from said first fold line therewith, and a score line formed in said second sheet adjacent said second sheet free end, said second sheet, when enclosing said stack, being fixed to said one planar item adjacent said planar item extended end on a side thereof opposite to that of said first sheet, said second sheet being generally co-extensive with said first sheet, said mailer being openable by gripping said first and second sheets adjacent said first and second fold lines, tearing said first and second sheets along said score lines, and withdrawing said stack from within said first and second sheets by a tab formed by torn segments of said first and second sheets resulting from tearing, said contiguous planar items further being separable along said cut lines to thereby extend the length of said stack when said stack is withdrawn and unfolded.

* * * * *